United States Patent [19]

Odaka et al.

[11] Patent Number: 4,858,780

[45] Date of Patent: Aug. 22, 1989

[54] HERMETICALLY SEALED PACKAGE AND METHOD OF PRODUCING THE SAME

[75] Inventors: Hiroshi Odaka, Himeji; Tsuyoshi Kishida, Tokyo, both of Japan

[73] Assignee: Idemitsu Petrochemical Co., Ltd., Tokyo, Japan

[21] Appl. No.: 242,127

[22] Filed: Sep. 9, 1988

[30] Foreign Application Priority Data

Sep. 9, 1987 [JP] Japan ..... 62-226158

[51] Int. Cl.[4] ..... B65D 41/00

[52] U.S. Cl. ..... 220/359; 220/260

[58] Field of Search ..... 220/359, 270, 276, 260

[56] References Cited

U.S. PATENT DOCUMENTS

| | | | |
|---|---|---|---|
| 4,350,263 | 9/1982 | Hoffman | 220/359 |
| 4,544,093 | 10/1985 | Stark et al. | 220/359 |
| 4,555,056 | 11/1985 | Bernhardt | 220/359 |
| 4,579,100 | 7/1985 | Ingemann | 220/359 |
| 4,586,624 | 5/1986 | Shaw | 220/359 |
| 4,689,099 | 5/1987 | Ito et al. | 220/359 |
| 4,693,390 | 9/1987 | Hekal | 220/359 |
| 4,693,391 | 9/1987 | Roth | 220/359 |
| 4,810,541 | 3/1989 | Newman et al. | 220/359 |

*Primary Examiner*—Joseph Man-fu Moy

*Attorney, Agent, or Firm*—Antonelli, Terry & Wands

[57] ABSTRACT

A hermetically sealed package comprising:

(a) a multilayer container comprising at least an innermost layer and a layer adjacent to the innermost layer, the innermost layer and the layer adjacent to the innermost layer being joined by a pressure sensitive adhesive, the multilayer container including (1) a recessed portion;

(2) a flat flange portion adjoining integrally the rim of the recessed portion; and (3) a notch surrounding the boundary between the recessed portion and the flat flange portion, the notch being provided on the flat flange portion in the innermost layer of the multilayer container; and (b) a top film including (1) a lid portion for sealing the multilayer container, the lid portion being adhered strongly to the flat flange portion of the multilayer container at the outside of the notch; and (2) a tab portion for picking the top film, the tab portion extending from the rim of the lid portion, being integral with the lid portion, and being not adhered to the flat flange portion;

the coefficient of adhesion between the multilayer container and the top film being larger than the coefficient of adhesion between the innermost layer of the multilayer container and the layer adjacent to the inner most layer of the multilayer container generated by the pressure sensitve adhesive, whereby upon progressive separation of the top film from the tab portion, the innermost layer is progressively peeled from the layer adjacent to the innermost layer, with the innermost layer inside the notch remaining unpeeled; and the pressure sensitive adhesive enabling to reseal the hermetically sealed package after opening.

6 Claims, 3 Drawing Sheets

HERMETICALLY SEALED PACKAGE AND METHOD OF PRODUCING THE SAME

BACKGROUND OF THE INVENTION (1) Field of the Invention

The present invention relates to a hermetically sealed package useful for packaging foods or liquids and to method of producing the hermetically sealed package and more particularly, to hermetically sealed package having a top film which may be opened and closed repeatedly by pressure sensitive adhesive and to method of producing the hermetically sealed package.

(2) Description of the Related Art

In conventional method of closing a plastic container filled with an article such as jelly by means of a top film, a top film made of a plastic material of a type similar to that of container material has been used to be adhered by heat sealing to the flange portion surrounding the container. Though the coefficient of adhesion between the top film and the container varies depending on the temperature and pressure of heat sealing, it is generally so large (about 3 kg/25 mm width) that the top film cannot be torn off by means of fingers and needs to be cut with a cutting instrument to gain access to the content of the container. If the heat seal is weakened for the facility of opening, there will be caused the possibility of incomplete seal or accidental opening of the sealed package during storage or conveyance.

To obviate the defect of the conventional method, there has been employed a method of heat sealing a container at the flange portion thereof with a top film which has been provided with a layer coated with a wax (melt layer). (This method is called hot melt method.) This method utilizes cohesive failure of the melt layer caused by the difference between the adhesion force and cohesive force thereof and thereby makes it easy to separate top film away. However, this method has a defect of lacking in oil resistance.

In another method, a top film made of a material different from that of container and provided with an adhesive resin layer comprising vinyl acetate copolymer is heat sealed to the container. In this method, proper selection of pressure, time, and temperature of heat sealing permits to control the bonding strength (for example, 800 g/25 mm width to 1.2 kg/25 mm width) so that even infants or the aged can peel off the top film from the container with fingers. However, this method also has a defect that the heat sealed portion is so poor in heating tolerance that the package thus produced cannot be used for packaging articles which are to be subjected to heating treatment, such as retort treatment, since the heat sealed portion will be marred by pinholes generated during such treatment.

There is also known a package wherein the container portion thereof having a recessed portion and a flange portion surrounding the recessed portion is formed from a two-layered multilayer sheet, and a notch surrounding the boundary between the recessed portion and the flange portion is provided in the innermost layer of the multilayer sheet on the flange portion. The container is sealed with a top film sheet to form a hermetically sealed package. The top film comprises a lid portion and a tab portion extending from the rim of the lid portion, and the tab portion will not be adhered to the flange portion. When the hermetically sealed package is opened, the tab portion is pulled to be separated from the edge of the container, whereby the multilayer sheet is initially delaminated from the edge of the package and the delamination progresses to the notch of the container, with a part of the innermost layer outside the notch remaining adhered to the top film. By pulling progressively the tab portion, the above-mentioned part of the innermost layer is separated away with the top film from the container, and the hermetically sealed package is consequently opened. This method utilizes the difference between the adhesion strength between the layers of the multilayer sheet (for example, 300 to 1,200 g/25 mm width) and the adhesion strength between the container and the top film (for example, 3 kg/25 mm width).

The increase of small households, particularly one-person households, and the requirement for the rationalization of life presents an ever-increasing demand for such hermetically sealed packages as throwaway packages for various foods and liquids, sanitary articles, etc.

However, a consumer of hermetically sealed package does not always consume whole articles packaged at a time. In the conventional hermetically sealed packages, the top film once opened cannot be reused for preserving the remaining article.

Therefore, when the article to be packaged is a sanitary article, such as a pocket disinfecting cotton or disinfecting towel, or foods being apt to be easily damaged by dryness or dampness, the article should be packaged in an amount enough to a single usage. For example, some articles such as pickled ume are on the market in a form packaged individually. Such packaging however increases the cost of packaging and is also undesirable from the viewpoint of resource-saving. For all that, it is troublesome to transfer the remaining article into another container for preservation.

Therefore, there has been a demand for an inexpensive hermetically sealed package having a top film which can be reused for preserving the remaining article.

Nevertheless, there has been provided no throwaway, hermetically sealed package satisfying the demand as far as the present inventors know.

SUMMARY OF THE INVENTION

An object of the present invention is to provide a throwaway, hermetically sealed package which can package hermetically an article in an amount sufficient for plural usages and has a top film being able to be reused repeatedly after being opened, and to provide a method of producing the hermetically sealed package.

Another object of the present invention is to provide a hermetically sealed package which is strongly sealed before use or during display and can be easily opened at the time of opening, and to provide a method of producing the hermetically sealed package.

Accordingly, the present invention provides a hermetically sealed package comprising:

(a) a multilayer container comprising at least an innermost layer and a layer adjacent to the innermost layer, the innermost layer and the layer adjacent to the innermost layer being joined by a pressure sensitive adhesive, the multilayer container including (1) a recessed portion;

(2) a flat flange portion adjoining integrally the rim of the recessed portion; and (3) a notch surrounding the boundary between the recessed portion and the flat flange portion, the notch being made on the flat flange portion in the innermost layer of the multilayer container; and (b) a top film including (1) a lid portion for sealing the multilayer container, the lid portion being adhered strongly to the flat flange portion of the multilayer container at the outside of the notch; and (2) a tab portion for picking the top film, the tab portion extending from the rim of the lid portion, being integral with the lid portion, and being not adhered to the flat flange portion;

the coefficient of adhesion between the multilayer container and the top film being larger than the coefficient of adhesion between the innermost layer of the multilayer container and the layer adjacent to the inner most layer of the multilayer container generated by the pressure sensitive adhesive, whereby upon progressive separation of the top film from the tab portion, the innermost layer is progressively peeled from the layer adjacent to the innermost layer, with the innermost layer inside the notch remaining unpeeled; and the pressure sensitive adhesive enabling to reseal the hermetically sealed package after opening.

The multilayer container to be used in the present invention is composed of at least two layers, preferably two layers each being made of a synthetic resin, and the two layers are laminated through a pressure sensitive adhesive. In other details, any technique employed conventionally in the art for forming multilayer containers may be applied for the multilayer container of the present invention.

The notch provided in the innermost layer of the multilayer container on the flat flange portion may surround completely around the peripheral portion of the boundary between the recessed portion and the flat flange portion, or extend incompletely around the peripheral portion with a part of the peripheral portion remaining unnotched. The part unnotched serves as a hinge of the top film whereby when preserving the remaining article in the package after opening, the package can be easily resealed by merely resetting the top film using the hinge as an axis.

Heretofore, multilayer sheets adhered by a pressure sensitive adhesive generally has not been used for molding containers since at the time of molding process, generation of bubbles occurs in the pressure sensitive adhesive layer resulting in moldings being extremely unpleasant in appearance. To ensure successful molding of the multilayer container of the present invention without generation of bubbles in the pressure sensitive adhesive layer, it is desirable to use a multilayer sheet laminated through a pressure sensitive adhesive which has been removed of the solvent therein by volatilization. The multilayer sheet may be produced by a method of coating a sheet layer with a pressure sensitive adhesive and subsequently laminating another sheet layer thereon, by coextruding the sheet materials with a pressure sensitive adhesive, or by any other method known in the art.

The innermost layer on the flat flange portion and outside the notch can be easily peeled from the layer adjacent to the innermost layer, and, on the other hand, the innermost layer and the top film are strongly adhered each other outside the notch. Thus, while a satisfactorily hermetic seal is provided, opening of the package is facilitated because when removing the top film from the multilayer container, the innermost layer is peeled initially from the layer adjacent to the innermost layer from the edge of the multilayer container and is progressively separated with the top film at and along the notch. Further, the pressure sensitive adhesive remaining adhered to the delamination surfaces of the innermost layer and the layer adjacent to the innermost layer makes repeated reseal and reopen of the top film possible.

When a space of 0.5 to 10 mm, preferably 1.5 to 5 mm, is left between the inner boundary of the adhered portion and the notch, the peeling strength from the inside of the package may be increased to be substantially larger than that from the outside of the package The preferred methods of providing a notch include a method of press with a cutting blade or heated blade and the like. The notch is generally provided by means of a U-shaped or V-shaped ring pressing object. When press and heating press are employed in combination, it is desirable that the resin material of the inner most layer has a melting point and a softening point lower than those of the resin material of the layer adjacent to the innermost layer. It is also desirable that the innermost layer is 200 μm or thinner in thickness. The notch may also be provided by pressure molding a multilayer sheet material through an infusible material such as metals or resins having a melting point and softening point higher than those of the innermost layer material of the multilayer sheet material. By the method, heat seal of top film and flat flange portion and formation of notch can be accomplished simultaneously.

DESCRIPTION OF THE PREFERRED EMBODIMENTS

The present invention hereinafter will be described in more details by means of embodiments of the present invention.

Figure 1:
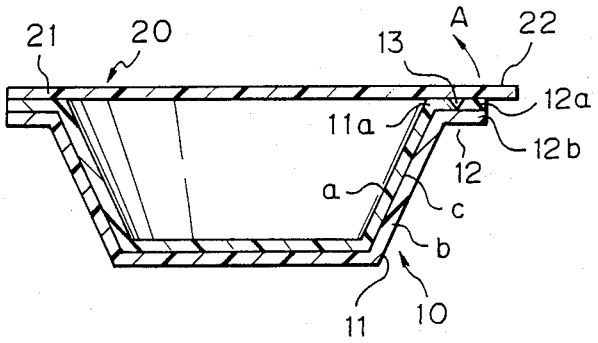
FIG. 1 is a sectional elevating view of a hermetically sealed package of an embodiment of the present invention.

Referring to FIG. 1, which is a sectional elevating view of a hermetically sealed package of an embodiment of the present invention, a multilayer container 10 includes a recessed portion 11 and a flat flange portion 12 adjoining integrally the rim of the recessed portion 11, and has a sectional view being shaped like a hut. The multilayer container 10 is molded from two synthetic resin sheets, a and b, and the sheets a and b are adhered each other with a pressure sensitive adhesive. In FIG. 1, the pressure sensitive adhesive layer c is shown as a line. For convenience in description, the sheet inside the multilayer container is called inner layer a, and the sheet outside the multilayer container is called outer layer b.

A notch 13 surrounding the boundary between the recessed portion 11 and the flat flange portion 12 is provided in the inner layer a of the adhered synthetic resin sheets on the flat flange portion 12.

Top film 20 includes a lid portion 21 having an acreage enough to cover the opening and the flat flange portion 12 of the multilayer container 10, and a tab portion 22 extending from the lid portion 21. The top film 20 may be a sheet of synthetic resin sheet. The lid portion 21 is strongly adhered, for example with a strong adhesive, to the surface of the flat flange portion 12 of the multilayer container 10. In place of using an adhesive, a synthetic resin material of a type similar to that of the inner layer a may be used to be heat sealed strongly. It is essential that the coefficient of adhesion between the lid portion 21 and the flat flange portion 12 is larger than the coefficient of adhesion of the pressure sensitive adhesive adhering the synthetic resin sheets, a and b. The tab portion 22 is not adhered to the surface of the flat flange portion 12. Before adhering the top film 20 to the multilayer container 10, an article to be packaged is introduced in the multilayer container 10.

Figure 2:
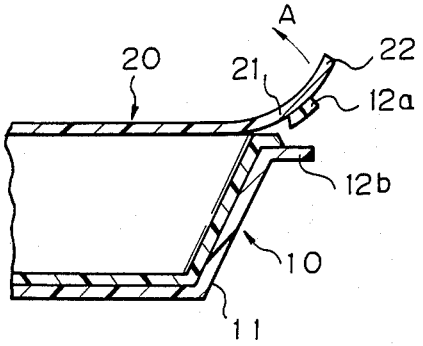
FIG. 2 is a partially sectional elevating view of the hermetically sealed package of FIG. 1 illustrating the top film being progressively peeled away.

Referring to FIG. 2, which is a partially sectional elevating view of the hermetically sealed package of FIG. 1, there is illustrated the top film 20 being progressively peeled away. Upon pulling the tab portion 22 to the direction of an arrow A, a part of the inner layer **12*a* of the flat flange portion 12 outside the notch 13 is pulled along with the top film 20, and is peeled at the pressure sensitive layer c because the coefficient of adhesion between the inner layer 12*a* and the lid portion 21 is larger than that between the inner layer 12*a* and the outer layer 12*b*. The inner layer 12*a* is subsequently cut at the notch 13 resulting in the removal of the top film 20**.

To the top film 20 thus removed does the inner layer **12*a* remain adhered, and to the delaminated surfaces of the inner layer 12*a* and outer layer 12*b* does the pressure sensitive adhesive remain adhered. Therefore, these surfaces with the pressure sensitive adhesive can be adhered again by pressing the top film 20** to reseal.

Figure 3:
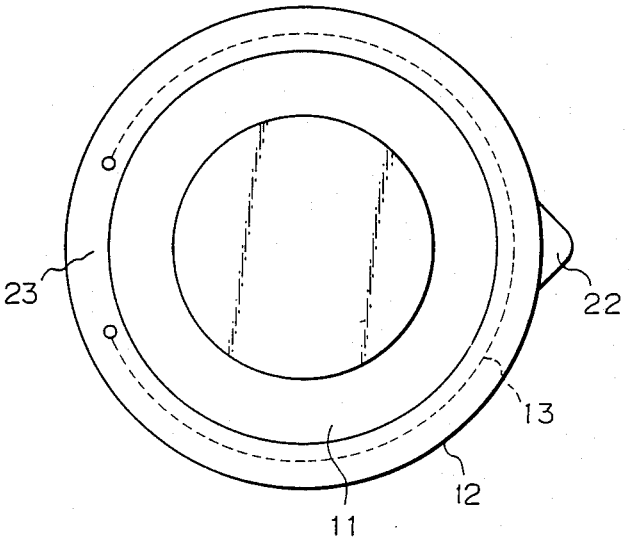
FIG. 3 is a bottom view of the hermetically sealed package of FIG. 1.

Referring to FIG. 3, which is a bottom view of the hermetically sealed package of FIG. 1, there is shown the protruding tab portion 22 which is not adhered to the flat flange portion 12 of the multilayer container 10. The notch 13 concealed in the layers of the package is shown by a dotted line. As shown in FIG. 3, the notch 13 is not provided to a portion 23 opposite to the tab portion 22. The part 23 supports the top film 20 to prevent the top film 20 from completely separating from the multilayer container 10, and serves as a hinge at the time of opening and shutting. It is advantageous to extend the both end portion of the notch 13 perpendicularly, or substantially perpendicularly to the direction of opening the top film 20. It provides the inner layer **12*a* with a resistance to some degree when the inner layer 12*a* is coming to be torn beyond the both ends of the notch 13 by the tensile force applied to the tab portion 22. At need, holes may be provided to both ends of the notch 13 to prevent the inner layer 12*a* from being torn at the hinge portion. The holes may be provided only to the inner layer 12*a***, or completely through the multilayer sheet material.

Figure 4:
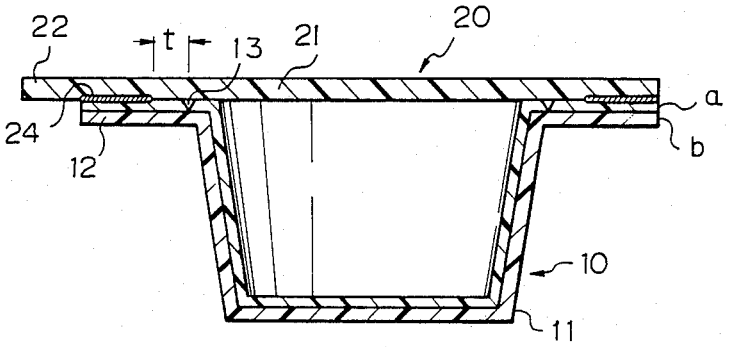
FIG. 4 is a sectional elevating view of a hermetically sealed package of another embodiment of the present invention.

FIG. 4 is a sectional elevating view of a hermetically sealed package of another embodiment of the present invention. The difference between the hermetically sealed packages of FIG. 4 and FIG. 1 is that in FIG. 4 the multilayer container 10 and the top film 20 are adhered at the flat flange portion 12 by heat seal, and a space t is left between the inner boundary of the heat seal portion 24 and the notch 13. The inner layer a and the outer layer b are laminated by adhering with a polyacrylateester base pressure sensitive adhesive.

To a multilayer container produced from a multilayer sheet material of 785 μm in thickness composed of an inner layer a of high density polyethylene and 60 μm in thickness, pressure sensitive layer of 25 μm in thickness, and an outer layer b of polypropylene and 700 μm in thickness was heat sealed a top film, leaving a space t of 4 mm between the inner boundary of the heat seal portion and notch. The peeling strength of the package thus produced from the outside of the package was 1.17 kg/25 mm width at a peeling velocity of 300 mm/min, and the peeling strength from the inside of the package was 4.25 kg/25 mm width. It shows the excellency of the package in both the sealing property against the internal pressure and the easy openability at the time of access to the content therein.

The repeeling strength and resealing airtightness of the hermetically sealed package produced as described above were measured, and the results were as follows.

Repeeling strength means the peeling strength from the outside of a resealed package, and the measurement thereof was conducted at a peeling velocity of 300 mm/min, after a predetermined times of repeating removal and resetting of top film from and to multilayer container. The results are shown in the following Table 1.

TABLE 1

| | Repeeling strength (kg/25 mm width) |
|---|---|
| The first time | 1.17 |
| The 2nd time | 0.83 |
| The 5th time | 0.63 |
| The 10th time | 0.60 |
| The 15th time | 0.58 |
| The 20th time | 0.58 |

Resealing airtightness means the airtightness of a resealed package, and the measurement thereof was conducted according to JIS Z 0222, after a predetermined times of repeating removal and resetting a top film from and to multilayer container. For the purpose of comparison, the measurement was also conducted on an unopened hermetically sealed package and a hermetically sealed package which had been opened with a cutter. After allowing a package to stand for a predetermined days at a temperature of 40±1° C., a humidity of 90±2%, and air flow of 1 m/s, the weight of moisture (g) absorbed by 100 g of calcium chloride charged in the package was measured. The results are shown in Table 2.

TABLE 2

| | Elapsed days | | | |
|---|---|---|---|---|
| Sample | 1 | 3 | 5 | 7 |
| Unopened package | 0 | 0 | 0.02 | 0.05 |
| After two times opening | 1.0 | 15 | 36 | 62 |
| After five times opening | 1.5 | 24 | 55 | 73 |
| After opening with a cutter | 38 | 61 | 86 | 114 |

As evident from the results shown in Table 2, the hermetically sealed package of the present invention is superior in sealing property to conventional inresealable packages.

Hereinafter, an example of the method of providing a notch to a multilayer container of the hermetically sealed package according to the present invention will be described referring to drawings.

Figure 5:
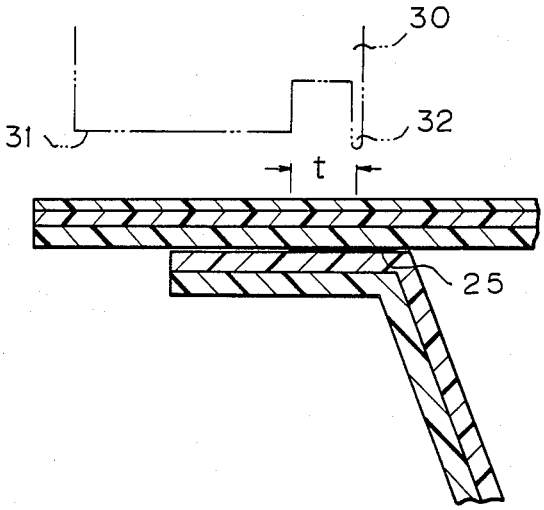
FIG. 5 is a partially sectional elevating view illustrating a method of providing a multilayer container with a notch and heat sealing a top film and a multilayer container simultaneously.
Figure 6:
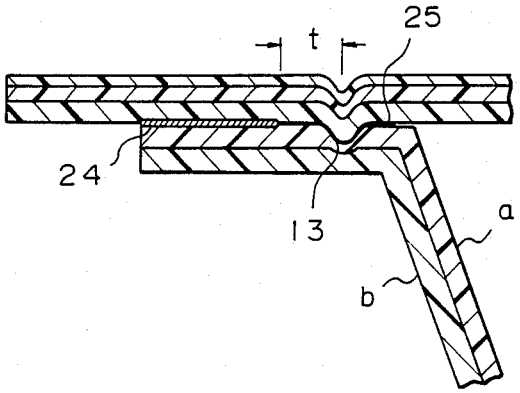
FIG. 6 is a partially sectional elevating view of a hermetically sealed package produced by the method illustrated in FIG. 5.

FIG. 5 and FIG. 6 are each a partially sectional elevating view illustrating a method of providing a multilayer container with a notch and heat sealing a top film and a multilayer container simultaneously. A heat seal ring 30 is equipped integrally with a heat sealing portion 31, a pressing object 32, and an upwardly recessed portion between the heat sealing portion 31 and the pressing object 32, the pressing object 32 being located at a distance of t from the sealing portion 31 for the purpose of providing a notch by heating press. After introducing an article, an infusible layer 25 is placed on the inner layer a, and the heat seal ring 25 is then pressed to the package. Thus heat seal and formation of notch can be simultaneously accomplished. This method permits the space t to be uniform and heat seal and forming of notch to be accomplished without damaging of the shape of package.

While the preferred forms and embodiments have been illustrated and described in details, it will be apparent that changes and modifications may be made without deviating from the inventive concepts set forth above.

For example, the multilayer sheet material of the multilayer container is not necessarily to be a multilayer sheet material composed of two layers, and may be one composed of 3 or more layers. Further, it is not necessarily one made of synthetic resins. Furthermore, the top film to be used may be of a resin, a metal foil such as aluminum foil, a laminate sheet, and the like.

What is claimed is:

1. A hermetically sealed package comprising:

(a) a multilayer container comprising at least an innermost layer and a layer adjacent to the innermost layer, the innermost layer and the layer adjacent to the innermost layer being joined by a pressure sensitive adhesive, the multilayer container including (1) a recessed portion;

(2) a flat flange portion adjoining integrally the rim of the recessed portion; and (3) a notch surrounding the boundary between the recessed portion and the flat flange portion, the notch being provided on the flat flange portion in the innermost layer of the multilayer container; and (b) a top film including (1) a lid portion of sealing the multilayer container, the lid portion being adhered strongly to the flat flange portion of the multilayer container at the outside of the notch; and (2) a tab portion for picking the top film, the tab portion extending from the rim of the lid portion, being integral with the lid portion, and being not adhered to the flat flange portion;

the coefficient of adhesion between the multilayer container and the top film being larger than the coefficient of adhesion between the innermost layer of the multilayer container and the layer adjacent to the inner most layer of the multilayer container generated by the pressure sensitive adhesive, whereby upon progressive separation of the top film from the tab portion, the innermost layer is progressively peeled from the layer adjacent to the innermost layer, with the innermost layer inside the notch remaining unpeeled; and the pressure sensitive adhesive enabling to reseal the hermetically sealed package after opening.

2. The hermetically sealed package as defined in claim 1, wherein the lid portion is adhered to the flat flange portion of the multilayer container at the outside of the notch so that a space of 0.5 to 10 mm is left between the inner boundary of the seal and the notch.

3. The hermetically sealed package as defined in claim 1, wherein the notch extends continuously throughout a major part of the flat flange portion leaving an unnotched hinge portion.

4. The hermetically sealed package as defined in claim 3, wherein a hole is bored in the innermost layer and the layer adjacent to the innermost layer at each end of the notch.

5. A method of producing a hermetically sealed package comprising the steps:

(a) forming a multilayer sheet material comprising at least two layers joined each other by a pressure sensitive adhesive into a multilayer container including a recessed portion and a flat flange portion adjoining integrally the rim of the recessed portion so that each of the two layers composes respectively innermost layer of the multilayer container and layer adjacent to the inner most layer of the multilayer container;

(b) making a notch surrounding the boundary between the recessed portion and the flat flange portion in the innermost layer on the flat flange portion of the multilayer container;

(c) introducing an article in the recessed portion of the multilayer container; and (d) adhering a top film strongly to the flat flange portion at the outside of the notch, the top film including a lid portion for sealing the multilayer container and a tab portion for picking the top film, the tab portion extending from the rim of the flat flange portion, being integral with the lid portion, and being not to be adhered to the flat flange portion of the multilayer container.

6. A method of producing a hermetically sealed package comprising the steps:

(a) forming a multilayer sheet material comprising at least two layers joined each other by a pressure sensitive adhesive into a multilayer container including a recessed portion and a flat flange portion adjoining integrally the rim of the recessed portion so that each of the two layers composes respectively innermost layer of the multilayer container and layer adjaccent to the innermost layer of the multilayer container;

(b) introducing an article in the recessed portion of the multilayer container; and (c) heat sealing strongly a top film to the flat flange portion of the multilayer container and making a notch surrounding the boundary between the recessed portion and the flat portion in the innermost layer on the flat flange portion of the multilayer container and inside the inner boundary of the heat sealed portion simultaneously, by pressing downwardly a heat seal ring after sandwiching an infusible layer covering the portion to which the notch is to be provided, the heat seal ring having an outer heat sealing portion for heat seal and an inner pressing object for providing the notch, the heat sealing portion and the pressing object being spaced each other by an upwardly recessed portion to provide a space between the inner boundary of the heat sealed portion and the notch of the multilayer container, the lower end of the pressing object being protruding downwardly from the level of the surface of the heat sealing portion so that a notch is formed in the innermost layer of the multilayer container by downward pressure applied through the infusible layer.

* * * * *